US006224234B1

(12) United States Patent
Demmery

(10) Patent No.: US 6,224,234 B1
(45) Date of Patent: May 1, 2001

(54) ILLUMINATED CARRIER

(76) Inventor: Renee Lynn Demmery, 120 Wiseria Ct., Tyrone, GA (US) 30290

( * ) Notice: Subject to any disclaimer, the term of this patent is extended or adjusted under 35 U.S.C. 154(b) by 0 days.

(21) Appl. No.: 09/328,676

(22) Filed: Jun. 9, 1999

(51) Int. Cl.[7] ..... A45C 15/06

(52) U.S. Cl. ..... 362/156; 362/154; 362/356; 362/806; 362/208; 362/253; 446/485

(58) Field of Search ..... 362/154, 156, 362/356, 806, 208, 253; 446/485

(56) References Cited

U.S. PATENT DOCUMENTS 4,698,732 * 10/1987 Hickey ..... 362/154
5,597,230 * 1/1997 Newman ..... 362/154
5,984,754 * 11/1999 Freelander ..... 446/73

* cited by examiner

*Primary Examiner*—Sandra O'Shea
*Assistant Examiner*—Ali Alavi
(74) *Attorney, Agent, or Firm*—Dave S. Christensen

(57) ABSTRACT

A hollow carrier having a handle in the shape of a jack-o-lantern or the like is provided with a light and diffuser assembly. When the light is activated, a portion of the light is reflected onto a path external to the carrier while another portion is reflected back into the carrier illuminating the carriers interior allowing the person holding the carrier to be visible from all directions.

27 Claims, 2 Drawing Sheets

ILLUMINATED CARRIER

BACKGROUND OF THE INVENTION

1. Field of Invention

The present invention relates generally to an illuminated carrier for holding small items such as treats and more specifically to a carrier which illuminates internally as well as the ground underneath the carrier. The internal and external illumination is accomplished with a single light source.

2. Description of Related Art

Trick-or-treating is a popular activity by young children on the Halloween holiday. Generally, the children carry a bag or a bucket-shaped carrier called a "jack-o-lantern" to hold the treats they collect by going door to door in their neighborhood. This activity commonly occurs near or after sunset, which makes it difficult to see the child. Since the children often have to cross streets, there is a significant risk that the child may be struck and injured by an automobile. The darkness also poses an additional risk of the child falling when walking over uneven ground.

To increase their safety, children often wear reflective clothing to make them more visible or carry a flashlight to light their path. While this does reduce the risk, there are some inherent disadvantages. The reflective clothing only covers certain portions of the child's body and unless the lights of the automobile hit the child in the right manner there's a probability that the child will not been seen. The flashlight however, does not increase the child's visibility unless the child is walking directly toward the automobile. The flashlight may also be problematic for smaller children who will have a hard time managing both the flashlight and their carrier.

Various jack-o-lantern's have been proposed to increase the visibility of the child. The U.S. Pat. No. 4,802,071 describes a carrier having a light source built into the top of the carrier. When the light is turned on, the inside of the carrier is illuminated. Since the carrier is made from a translucent material, a portion of the light will pass through the carrier making it glow. The glowing carrier thus makes the child more visible from all directions.

The U.S. Pat. No. 5,597,230 describes a carrier having light sources built into the "eyes" of the jack-o-lantern. When the light source is turned on, the decorative eyes of the carrier act like flashlights to light the path for the child. While this invention does solve the problem of the child having to handle both a carrier and a flashlight, it does not make the child any more visible from the rear or side directions.

Accordingly, it is considered advantageous to have a jack-o-lantern carrier that can both illuminate the carrier internally and the path below the child. It is also considered advantageous to have this illumination created by a single light source to ease assembly and reduce manufacturing costs.

SUMMARY OF THE INVENTION

The present invention is directed to a hollow carrier for carrying treats. The carrier having a hollow shaped body with a first opening formed in a top portion, this first opening being sized to allow treats to be inserted into and removed from the interior of said body. The body also has a second hole in a bottom portion. A diffuser is adapted to be received by the body's second hole and a light source is attached to the diffuser.

BRIEF DESCRIPTION OF DRAWINGS

These and other features, aspects, and advantages of the present invention will become better understood with reference to the following description, appended claims and accompanying drawings where:

DETAILED DESCRIPTION OF THE INVENTION

Figure 1:
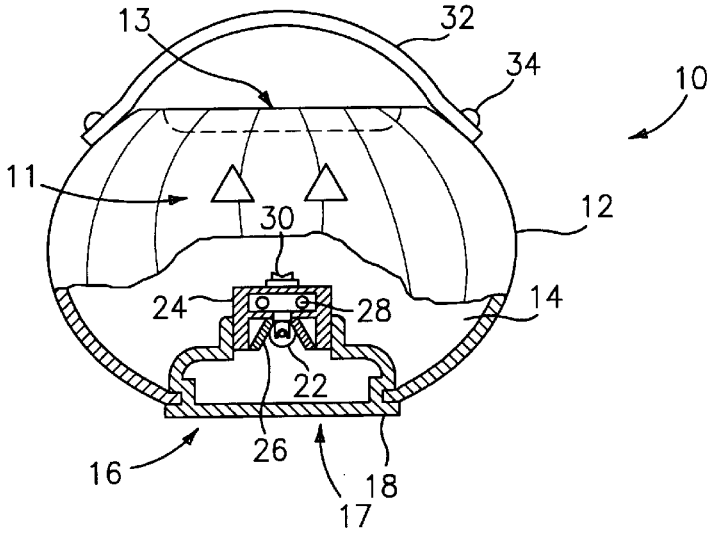
FIG. 1 is a side view partially in section of the carrier in accordance with the preferred embodiment.

As shown in FIG. 1, a carrier 10 for carrying treats is provided. The carrier is comprised of a generally hollow body 12 that holds the treats. The body 12 has a ornamental face design 11 on it's outer surface. When used for trick or treating, the face design 11 could be similar to those seen on jack-o-lanterns. The body 12 also has an upper opening 13 which is sized to allow a child to place her hand into the opening to deposit treats. Opposite this upper opening 13 is a lower opening 16 having a purpose which will be made clearer herein. Attached to the body 12 is a handle 32. The handle 32 can be attached to the body 12 by any convenient means, such as a snap 34. Other methods of securing the handle could include using a screw, rivet, or by adhesive bonding. Inserted into the lower opening 16 is a light-diffuser assembly 17.

The body 12 is made from a translucent material such as polypropylene or polyethylene that is easily molded into the shape desired. The desire to have the material be translucent will be made clearer herein.

Figure 2:
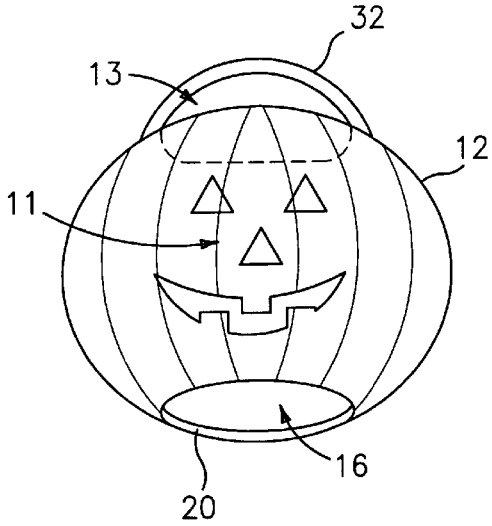
FIG. 2 is a perspective view of the body portion of the carrier.

As is best seen in FIG. 2, the lower opening 16 has a rim 20 defining the outer surface of the opening. This rim 20 is used to hold the light-diffuser assembly 17 to the body 12.

Figure 3:
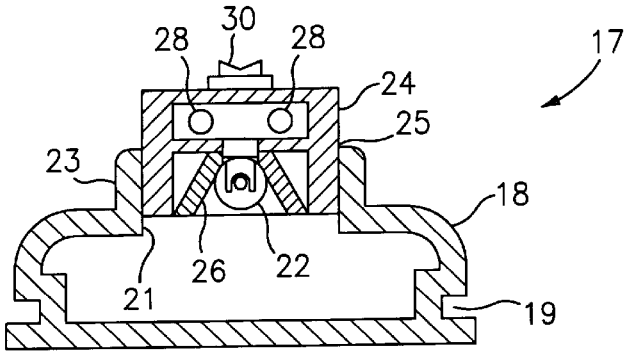
FIG. 3 is a side view in section of the light-diffuser assembly of the preferred embodiment.

The light-diffuser assembly is shown in FIG. 3. The light-diffuser assembly comprises a generally hollow diffuser 18 having a groove 19 extending circumferentially around the outer diameter of the diffuser 18. This groove 19 interacts with the rim 20 of the body 12 to hold the assembly 17 in the body 12. The diffuser 18 is made of an opaque material such as polypropylene, polyethylene, polycarbonate or glass.

The diffuser 18 also has an open cylindrical projection 23 having a threaded inner surface 21. The housing 24 has a corresponding threaded surface 25 which is used to attach the housing 24 to the diffuser 18. The housing 24 holds the light bulb 22, a reflector 26. the batteries 28 and a switch 30. The light bulb 22 mounts to the housing in a typical fashion to that used in flashlights.

When the switch 30 is moved to the "On" position, current is allowed to flow from the batteries 28 to the light bulb 22 creating the desired illumination. The amount of light entering the diffuser 18 is further increased by the conical reflector 26. The reflector 26 is shaped to reflect any light striking its surface into the diffuser 18. Once the light enters the diffuser, a certain portion will continue to travel downward through the bottom of the diffuser to illuminate the area below the carrier 10. The remaining portion of the light will be reflected by the opaque diffuser back in to the hollow body 12. This reflected light will exit the through the wall of the hollow body 12 making the body 12 "glow" thus increasing the visibility of the person carrying the carrier 10 in all directions.

The quality level of the illumination is directly dependent on the distance from the bottom of the carrier to the light source. The larger the distance results in greater internal illumination, however, the increased distance also results in a proportional decrease in the amount of light exiting the carrier to illuminate the path. The ideal location to place the light source depends on the size of the carrier and the amount of light that is required to illuminate the path. For example, in a typical jack-o-lantern type of carrier, the desired distance from the bottom of the carrier to the light source will be approximately 31.75 mm (1.25 inches).

Figure 4:
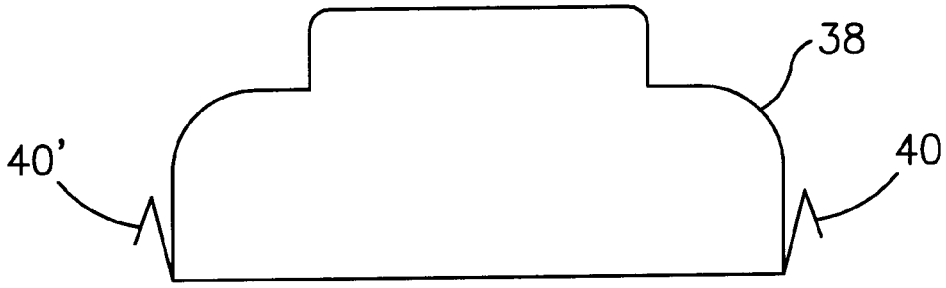
FIG. 4 is a side view of an alternate embodiment of the diffuser.

An alternate embodiment of the diffuser 38 is shown in FIG. 4. In this embodiment, the diffuser 38 has clips 40, 40' which are used to attach the diffuser 38 to the hollow body 12.

Figure 5:
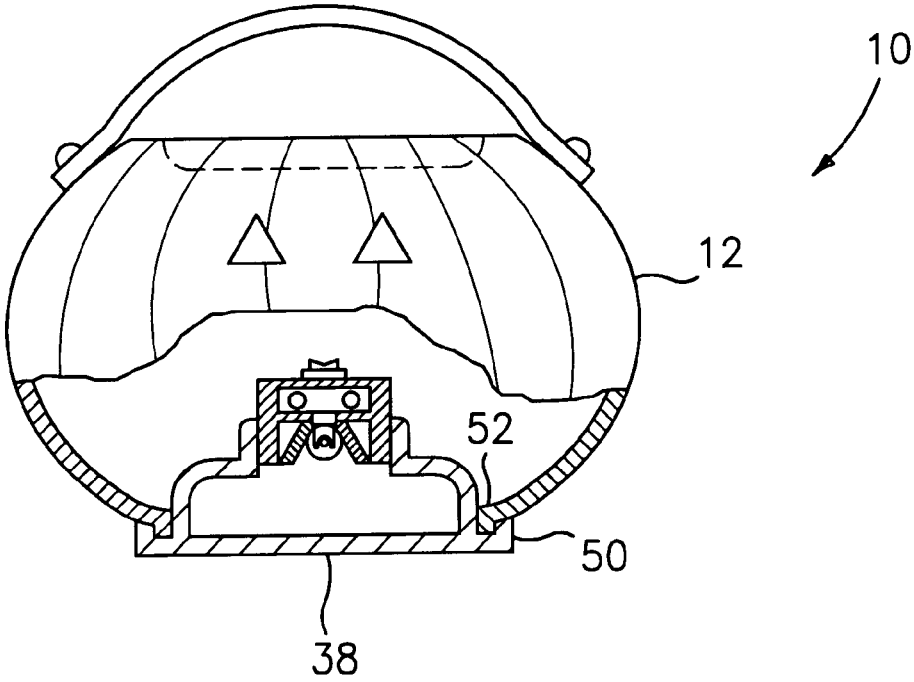
FIG. 5 is a side view partially in section of an alternate embodiment of the carrier.

Another alternate embodiment of the diffuser 38 is shown in FIG. 5. In this embodiment, the diffuser 38 has a rim 50 that slides onto a projection 52 on the carrier 12. The diameters of the rim 50 and the projection 52 are such that there is a small interference fit. Due to the ductility of the material of the diffuser 38 and carrier 12 the rim 50 and projection 52 deflect to allow assembly. The resulting compression fit holds the diffuser 38 on the carrier 12.

Although the present invention has been described with reference to certain embodiments, it will be appreciated that these embodiments are not limitations and that the scope of the invention is defined by the following claims.

What is claimed is:

1. A hollow carrier for carrying treats comprising:

a hollow shaped body having a first opening formed in a top portion, said first opening being sized to allow treats to be inserted into and removed from the interior of said body;

a diffuser attached to said body;

a light source within said body, said light source directing light into said diffuser, said diffuser reflecting a portion of said light to illuminate said hollow shaped body.

2. The carrier of claim 1 wherein:

said body also includes a second hole in a bottom portion; and, said diffuser is adapted to be received by said body second hole.

3. The carrier of claim 2 wherein said light source includes a housing attached to said diffuser, power supply mounted to said housing, a light bulb mounted within said housing and a switch, said switch being electrically connected between said light bulb and said power supply.

4. The carrier of claim 3 wherein said light source also includes a reflector, said reflector being mounted in said housing such that light generated by said light bulb is directed into said diffuser.

5. The carrier of claim 4 wherein said diffuser is made from an opaque material and being shaped such that a first portion of the light generated by said light bulb is reflected into the hollow body.

6. The carrier of claim 5 wherein said diffuser is shaped such that a second portion of the light generated by said light bulb is reflected through said body second hole.

7. The carrier of claim 6 wherein said body is made from a translucent material.

8. The carrier of claim 7 further comprising:

a handle attached to said body adjacent to said body first opening.

9. The carrier of claim 8 wherein said diffuser has a threaded portion and said light source housing has respective threaded portion that mates with said diffuser threaded portion.

10. The carrier of claim 9 wherein said diffuser is made from a plastic material.

11. The carrier of claim 10 wherein said plastic material is selected from the group consisting of polypropylene, polyethylene and polycarbonate.

12. The carrier of claim 9 where said diffuser is made from glass.

13. The carrier of claim 3 wherein said light bulb is spaced a distance up to 33.75 mm from the bottom of said carrier.

14. A hollow carrier for carrying treats comprising:

a hollow shaped body having a first opening formed in a top portion, said first opening being sized to allow treats to be inserted into and removed from the interior of said body, said body also includes a second hole in a bottom portion and a uniform wall thickness;

a diffuser said diffuser is adapted to be received by said body second hole;

a light source within said diffuser, said light source directing light into said diffuser, said diffuser reflecting a portion of said light to illuminate said hollow shaped body.

15. The carrier of claim 14 wherein:

said diffuser is generally cylindrical and includes a groove extending circumferentially around a diffuser outer surface, said groove being sized to receive said body uniform wall thickness.

16. The carrier of claim 14 wherein:

said diffuser is generally cylindrical and includes a plurality of clips formed along the perimeter of said diffuser for attaching said diffuser to said body.

17. The carrier of claim 16, wherein said light source includes a housing attached to said diffuser, power supply mounted to said housing, a light bulb mounted within said housing and a switch, said switch being electrically connected between said light bulb and said power supply.

18. The carrier of claim 17 wherein said light source also includes a reflector, said reflector being mounted in said housing such that light generated by said light bulb is directed into said diffuser.

19. The carrier of claim 18 wherein said diffuser is made from an opaque material and being shaped such that a first portion of the light generated by said light bulb is reflected into the hollow body and such that a second portion of the light generated by said light bulb is reflected through said body second hole.

20. The carrier of claim 17 wherein said light bulb is spaced a distance up to 33.75 mm from the bottom of said carrier.

21. A hollow carrier for carrying treats comprising:

a hollow shaped body having a first opening formed in a top portion, said first opening being sized to allow treats to be inserted into and removed from the interior of said body, said body also includes a second hole in a bottom portion and a projection adjoining said second hole, said body having a uniform wall thickness;

a diffuser, said diffuser is adapted to be received by said body second hole;

a light source within said body, said light source directing light into said diffuser, said diffuser reflecting a portion of said light to illuminate said hollow shaped body.

22. The carrier of claim 21 wherein:

said diffuser is generally cylindrical and includes a groove sized to receive said body projection extending circumferentially around a diffuser outer surface, said groove being formed by a rim.

23. The carrier of claim 22 wherein said rim diameter is less than said body projection diameter.

24. The carrier of claim 23, wherein said light source includes a housing attached to said diffuser, power supply mounted to said housing, a light bulb mounted within said housing and a switch, said switch being electrically connected between said light bulb and said power supply.

25. The carrier of claim 24 wherein said light source also includes a reflector, said reflector being mounted in said housing such that light generated by said light bulb is directed into said diffuser.

26. The carrier of claim 25 wherein said diffuser is made from an opaque material and being shaped such that a first portion of the light generated by said light bulb is reflected into the hollow body and such that a second portion of the light generated by said light bulb is reflected through said body second hole.

27. The carrier of claim 26 wherein said light bulb is spaced a distance up to 33.75 mm from the bottom of said carrier.

* * * * *